US005310277A

United States Patent [19]

Uotila

[11] Patent Number: 5,310,277

[45] Date of Patent: May 10, 1994

[54] MEANS AND NET FOR SLOWING DOWN AND/OR STOPPING THE MOTION OF A LAND VEHICLE

[75] Inventor: Jarmo Uotila, Lepsämä , Finland

[73] Assignee: Arrestarum Ltd., Klaukkala, Finland

[21] Appl. No.: 689,844

[22] PCT Filed: Nov. 21, 1989

[86] PCT No.: PCT/FI89/00213

§ 371 Date: Jul. 2, 1991

§ 102(e) Date: Jul. 2, 1991

[87] PCT Pub. No.: WO90/05809

PCT Pub. Date: May 31, 1990

[30] Foreign Application Priority Data

Nov. 22, 1988 [FI] Finland ..... 885396
May 2, 1989 [FI] Finland ..... 892100

[51] Int. Cl.[5] ..... E01F 13/00; E01F 15/00

[52] U.S. Cl. ..... 404/6; 256/13.1

[58] Field of Search ..... 404/6; 244/110 A–110 B, 110 R, 110 C; 256/1, 13.1

[56] References Cited

U.S. PATENT DOCUMENTS 2,465,936 3/1949 Schultz .
2,854,201 9/1958 Cotton .
2,952,336 9/1960 Cushman ..... 244/110 A
2,957,657 10/1960 Frieder et al. .
3,670,997 6/1972 Fonden et al. ..... 244/110 C
3,695,559 10/1972 Cruger et al. ..... 244/110 C
3,810,595 5/1974 Doolittle ..... 244/110 C
4,456,205 6/1984 Alavoine et al. ..... 244/110 C
4,759,655 7/1988 Gorlov ..... 404/6
4,780,020 10/1988 Terio ..... 404/6
4,818,137 4/1989 Gorlov ..... 404/6
4,923,327 5/1990 Gorlov ..... 404/6
4,979,817 12/1990 Crisp ..... 256/13.1

FOREIGN PATENT DOCUMENTS 174694 3/1961 Sweden .
344314 of 1972 Sweden .

*Primary Examiner*—James R. Brittain
*Assistant Examiner*—Nancy P. Connolly
*Attorney, Agent, or Firm*—McGlew and Tuttle

[57] ABSTRACT

A device for impeding the motion of a land vehicle is provided including a net having a first and a second end wherein the ends are separated to provide an elongated net arranged for grabbing a motor vehicle. A first braking device and a second braking are provided. The first braking device includes structure for slowing down the motion of the vehicle, and the second braking device includes structure for further slowing down and stopping the motion of the vehicle. The first and second members of the first braking device are shorter in length than the first and second members of the second braking device, such that the first and second braking device function stepwise with the first braking device braking the net first, and the second braking device braking the net second. The net is also formed of warp elements defining a vehicle wheel engaging structure which extends around the wheel of the vehicle when the vehicle runs over the net.

18 Claims, 3 Drawing Sheets

MEANS AND NET FOR SLOWING DOWN AND/OR STOPPING THE MOTION OF A LAND VEHICLE

FIELD OF THE INVENTION

The present invention concerns a net for slowing down and/or stopping the motion of a land vehicle.

BACKGROUND OF THE INVENTION

It is necessary in some circumstances to be able to stop a moving vehicle or to slow down its motion by expedients external to the vehicle. A situation like this may present itself e.g. when it becomes mandatory to stop a vehicle which its driver, for instance a fleeing traffic offender, will not stop without compulsion. Another situation is that in which it is desirable to slow down the motion of a vehicle that is running off the paving and moving erratically, and to stop the vehicle in order to prevent damage.

It is known in prior art to use a so-called spiked mat in stopping a vehicle. The spiked mat is a means provided with spikes which are fixed or may come loose, and intended to be laid across the roadway, its purpose being to puncture the tires of the vehicle running over the mat. As the air escapes from the tires, the speed of the vehicle will slow down because the rolling resistance of the tires increases greatly. At the same time, the steerability of the vehicle is impaired and it can no longer be driven at high speed.

The problem encountered when using spiked mats is that the vehicle which should be stopped may continue even a long way after its tires have been punctured.

It is also a problem when using spiked mats that as a result of losing its steerability the vehicle may run off the road or, for instance, collide with meeting vehicles.

For preventing the vehicle from running off the road, it is known in the art to use various, fixed or loose, obstacles. Such obstacles may take the form, for instance, of fences made of metal sections, timber, concrete or another equivalent solid material. It is also common practice to use for lighter objects to slow down motion and to cushion bumps on race tracks, straw bales or other kinds of padding. Heavy and firmly fixed obstacles are likely to injure the driver or the vehicle. Both kinds of obstacle are unsatisfactory as to their stopping power.

SUMMARY AND OBJECTS OF THE INVENTION

The object of the invention is to eliminate the drawbacks mentioned above.

The object of the invention is further to provide a net for grabbing the vehicle which affords optimum grabbing of the vehicle and, at the same time, grabbing of the car's wheels in order to prevent the vehicle from getting loose.

In order to accomplish this, the means of the invention for slowing down and/or arresting the motion of a land vehicle includes a net structure with brake members as described below. The net of the invention for slowing down and/or arresting the motion of a land vehicle includes a heavy rope a foot rope and interesting warp elements as described below.

The means of the invention comprises an elongated net arranged to grab the moving vehicle; and brake members connecting the net with substantially fixed anchoring points. As taught by the invention, said brake members comprise first brake members and second brake members; one first brake member and one second brake member have been disposed on each end of the net; and the first brake member on either end of the net has been connected to the near end of the net and the second brake member has been connected to the opposite end of the net.

This crossing arrangement of the second brake members has the effect that the vehicle to be stopped, after driving into the net, is bagged in the net, whereby escape of the vehicle is efficiently prevented. The elongated net has advantageously the form e.g. of a rectangle, the brake members being connected to the end of the rectangle's short sides.

In an embodiment of the means, the brake members are arranged to operate stepwise; and the first brake members are members retarding the speed of the vehicle; and the second brake members are members further retarding the speed and stopping the motion. Stepwise action is here understood to mean that action of the brake members commences at different times. The brake members may operate simultaneously at least part of the time, or they may operate fully consecutively so that after one brake member has operated the other brake member begins to operate. The brake members may be dimensioned for different braking forces, and their braking distances may also be different. The crossing arrangement of the brake members has the effect that when a vehicle has driven into the net the first brake members begin to operate in the first step and furnish at least the major part of the braking force. At a certain stage the second brake members begin to operate, thus joining the braking event. Since the second brake members have been attached crosswise on both ends of the net, the vehicle will be bagged in the net. The vehicle stops as soon as the second brake members have stopped their braking action and have become locked.

In an embodiment of the means the brake members are discardable fabric brakes. A fabric brake is a member usually formed of one or several ribbons. The brake member may for instance be composed in that two ribbons have been woven or stitched together over a certain length. The brake member usually has two ends, on which draw members have been formed. Pulling on the draw members will produce in the brake member a substantially uniform braking force opposing the pull so that the ribbons are forced to be torn apart. Brake members of this type have been described, for instance, in the Finnish patent application FI 893910.

In an embodiment of the invention the first brake members are members which open, and the second brake members are members which become locked. The characterization of members as members which open is understood to mean that in conclusion of their operation the first brake members altogether cease to operate, and release their grip. The second brake members become locked in conclusion of their retarding effect, whereby the braking force increases to great height in the end. The locking brake members may, for instance, be locking fabric brakes such as are disclosed in the Finnish patent application FI 893910, which do not come open after having braked all the way to the end.

In an embodiment of the means the second brake members are fabric brakes in which the braking force has been graduated stepwise to increase to essentially great height on conclusion of braking. On the terminal end of a fabric brake may be provided a braking portion where the braking force is higher than that at the beginning of braking. For instance, when the brake members are hitched to tow hooks of cars, the ultimately active braking force of the fabric brake may advantageously be higher than the friction force of the anchoring cars against their base.

In an embodiment of the invention the brake members are hitched to anchoring points on immobile vehicles, for instance to tow hooks, and/or to fixing sites offered by the terrain, such as ground, trees, stubs, stones, or the like. When the brake members are hitched to anchoring points on vehicles, e.g. to tow hooks, a means is obtained which can be rapidly set up for action. Additional anchoring points may be provided e.g. on trees. It is equally possible to anchor the brake members to fixed anchoring points on the border of the roadway which have been formed e.g. of fixing elements fixed in the concrete base.

In an embodiment of the invention the means comprises two nets, one after the other, which have been offset relative to each other in the longitudinal direction of the nets a distance substantially equivalent to one half of the net's mesh diagonal. It is possible with two nets, one after the other, located immediately adjacent to each other and laterally offset relative to each other so that the centre of each mesh of one net coincides with a nodal point of the other net's warp elements, to ensure advantageous seizing of the vehicle in the net and holding on to the vehicle because the front corners of the vehicle will more positively in every case push through one mesh of the net, whichever happens to meet the corner. It is obvious that any number of nets, such as may be considered necessary, can be placed one after the other.

The means of the invention is used as a safety fence, e.g. on the side of the track or roadway or placed in position across the driving lane to stop a vehicle.

The net for slowing down and/or stopping the motion of a land vehicle comprises a head rope and a foot rope, both longitudinal to the net, and warp strings therebetween forming the mesh of the net, and the mesh size of the net is substantially consistent with the size of the wheel of the vehicle to be slowed down or stopped. Ribbon-like material should in this context be understood to mean e.g. slab-like or ropelike material formed as well of yarn by weaving or formed of coherent material.

When the mesh size of the net is substantially consistent with the size of the vehicle's wheel, excellent seizing of the net on the vehicle, and especially on its wheels, is achieved. The net behaves in such a way that part of it is entrained under the vehicle and under its tires, whereby it will readily attach itself to the wear surface of the tire and, adherent thereto, will begin to wind itself along with the wheel around the axle assembly and other undercarriage structures. This renders the vehicle unable to extract itself from the net, even if it should try to back out.

In an embodiment of the net, substantially all warp strings are positioned at an oblique angle against the longitudinal direction of the net. In this way advantageous seizing of the vehicle and wrapping of the net around the vehicle and its parts are achieved, so that a maximum of warp strings participate in keeping the vehicle in the net. It is also a fact that the meshes of the net will be advantageously positioned around the corners of the vehicle.

In an embodiment of the invention the meshes have substantially the shape of a quadrangle, such as a parallelogram, square or rhombus, standing on its point in the vertical direction of the net, and the diagonal of the mesh substantially parallels the length direction of the net. This shaping of the mesh of the net further promotes the winding and clinging of the net to the body of the vehicle, and to the wheels. When the net winds itself around the vehicle, the diagonal of the net's mesh becomes positioned substantially parallel to the tire's plane of rotation and the sides of the mesh (e.g. parallelogram, square or rhombus), in such manner that they tend to adhere to the surface of the tire, whereby the wheel easily slips through the mesh of the net.

In an embodiment of the invention the length of the mesh diagonal is 0.5 to 1.0 m, suitable 0.6 to 0.9 m, and advantageously 0.7 to 0.8 m. The tires of passenger cars trafficking the highways, the outer diameters of the wheels are equal in size within rather narrow limits, and it is therefore possible to design the means of the invention in such a way that it is fit, as to its dimensioning, with greatest possible coverage, for use in stopping any passenger car that is in motion on the road.

In an embodiment of the net the height of the net is 1.2 to 2.2 m, suitably 1.5 to 2.0 m, and advantageously 1.6 to 1.9 m. The heights of the front part of passenger cars trafficking the highways are similar within rather close limits, and it is therefore possible to design the means of the invention so that it is fit, as to its dimensioning, with the greatest possible coverage, for use in stopping any passenger car that is in motion on the road. The height of the net in relation to the driver's eye level is also a psychologically significant variable: it is possible by means of various net heights to regulate the reaction of the driver after he has perceived the net. If the head rope of the net is at substantially greater height than the driver's eye, it is probable that the driver will commence panic braking once he sees the net because in his subconscious he fears that the net will hurt him. If on the other hand the head rope of the net is located below the driver's eye level, he is not frightened by the net and instead believes himself able to push through. In this manner he can in fact be enticed to drive into the net. Selection of the net height can be made according to conditions in each particular instance.

In an embodiment of the net the length of the net is 6 to 9 m, advantageously 7 to 8 m. The length of the net is advantageously equivalent to the width of a two-lane roadway.

In an embodiment of the net the net is made of polyester fabric ribbon and/or of nylon fabric ribbon. With these materials the net will be advantageous as to tensile strength and light weight.

In an embodiment of the net the head rope and foot rope form on the ends of the net a first hitching loop and a second hitching loop. The hitching loop is advantageously large enough to allow the brake members to pass through. In that case no particular, e.g. metallic, fixing clamps etc. are needed which might damage the side of the vehicle after the net has become wound around the vehicle.

In an embodiment of the net the difference between the lengths in the direction of the net of the first and second fixing loops is sufficiently equal to one half of the mesh diagonal. When using two identical nets consecutively close to each other, one may achieve the offset between the two nets in the amount of half a mesh by the simple expedient that the fixing loops differing in size in the proportion mentioned are superimposed and the net is fixed in place, whereby the desired offset will take place.

In an embodiment of the net the warp elements of the net are knotted. Joining of the net's warp elements with each other may naturally equally be accomplished by any other suitable joining method, e.g. by sewing, weaving, knitting, etc.

In an embodiment of the net warp element has been formed of two ribbons woven or stitched together upon each other.

In an embodiment of the net the crossing point of the warp elements has been formed in that the superimposed ribbons have been separated at the point of crossing and the crossing warp element passes between the ribbons.

In an embodiment of the net each warp element forms a reciprocatingly meandering figure, and the warp elements interlock at the corner points. This interlocking of the weft threads may be accomplished by any suitable joining method, e.g. by knotting, stitching, pushing one through the other, etc.

In an embodiment of the net the warp has between nodal points been rotated 180° about its longitudinal axis. When the warp elements are made of two superimposed and mutually joined ribbons and the warp elements are in a suitable manner interlocked by knotting, said longitudinal rotation affords the advantage that when the superimposed ribbons of the warp are torn apart, the ribbons do not end up constituting two separate nets, and the strength of the whole net cannot be substantially impaired even if such rupture should occur.

The net of the invention is used as safety fence, e.g. on the side of the roadway or, placed across the roadway, to stop a vehicle.

It is an advantage of the invention that the vehicle can be stopped independent of its driver's actions.

It is an advantage of the invention that the vehicle can be stopped in a controlled manner, without causing any danger.

Further, thanks to the invention, the vehicle can be stopped on a pre-determined, comparatively short distance.

It is furthermore an advantage of the invention that it will not damage the vehicle nor injure its driver or passengers.

It is furthermore an advantage of the invention that it is easily and rapidly set up in operating condition.

It is furthermore an advantage of the invention that it can be devised to be light of its weight and transportable with ease, and presenting good operating efficiency at the same time.

It is an advantage of the invention that the vehicle that has been stopped with the means cannot get free by backing. It follows that a vehicle once stopped cannot escape.

It is an advantage of the invention that with the invention is achieved particularly effective grabbing of the vehicle in the net so that any chance of getting free from the net is inhibited.

BRIEF DESCRIPTION OF THE DRAWINGS

In the following the invention is described in detail, referring to the attached drawing, wherein.

DETAILED DESCRIPTION OF THE PREFERRED EMBODIMENT

Figure 1:
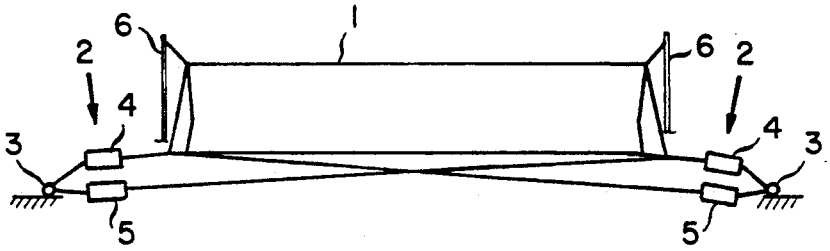
FIG. 1 presents schematically in elevational view, an embodiment of the means of the invention.

In FIG. 1 is depicted, schematically and in elevational view, an embodiment example of the means of the invention, comprising a net 1 for grabbing a vehicle in motion, and brake members 2 which connect the grabbing member with fixed anchoring points 3. The net 1 is an elongated net, between its both ends and the anchoring points 3 having been provided the brake members 2 to connect the net and the anchoring points with each other. The net 1 has been stretched in readiness for operation, with vertical supports 6. The brake members 2 are attached on either side of the net 1, at the ends of its short sides.

The brake members 2 comprise first brake members 4 for slowing down the motion of the vehicle and second brake members 5 for further slowing down and stopping the motion of the vehicle. The brake members 2 are discardable fabric brakes in which the braking force is produced by ripping off each other parts of fabric webbing which have been secured to each other. The first brake members 4 are here opening-type fabric brakes which release on exhaustion of their braking capacity. The second brake members 5 are discardable fabric brakes which are of the type that becomes locked on exhaustion of the braking capacity. A locking-type fabric brake may, for instance, be such as is described in the Finnish patent application FI 893910.

On either end of the elongated net 1 there is one set of first brake members 4 and one set of second brake members 5. The first brake members 4 on either end of the net are connected to the nearest end of the net 1. The second brake members 5 on either end of the net are connected to the opposite end of the net. Thus, the first brake member 4 on the left of the net is connected to the left end of the net. The second brake member 5 on the left of the net is connected to the right end of the net. The first brake member 4 on the right of the net is connected to the right end of the net. The second brake member 5 on the right of the net is connected to the left end of the net.

Figure 2:
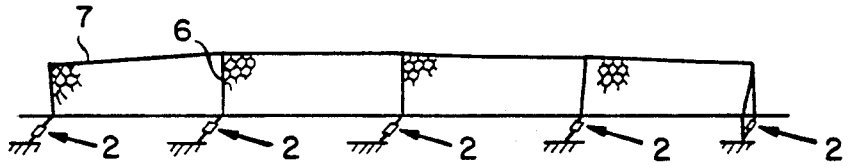
FIG. 2 presents another embodiment of the means of the invention.

In FIG. 2 is depicted another embodiment example of the means of the invention, wherein the elongated net has been formed to constitute a fencelike structure, and which comprises a plurality of brake members 2, disposed with suitable spacing along the net 1. The brake members 2 are at one end anchored to the ground, in any suitable manner.

Figure 3:
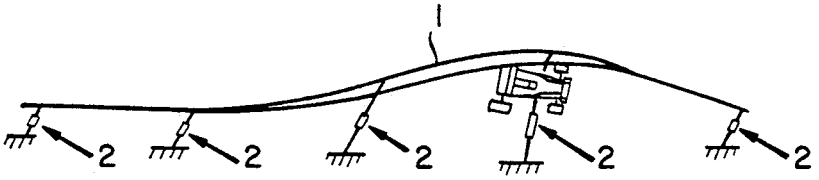
FIG. 3 presents the embodiment of FIG. 2, in a situation of its practical application, and in top view.

In FIG. 3 is depicted, as viewed from above, the safety fence of FIG. 2, in an operating situation in which a racing car has driven off the track. The brake members 2 have slowed down the motion of the car and have finally become locked, preventing it from dashing any farther in an undesirable direction, e.g. into the mass of spectators.

Figure 4:
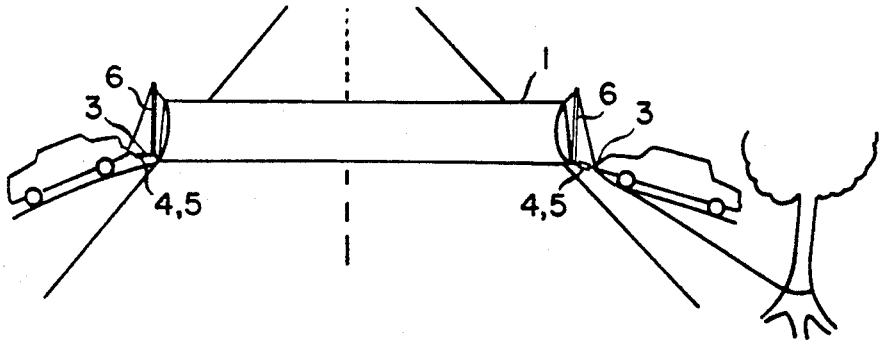
FIG. 4 presents the embodiment of FIG. 1, placed across the roadway.

In FIG. 4 the means of FIG. 1 has been installed across the roadway. The first brake members 4 and the second brake members 5 have been hitched to anchoring points 3 on immobile vehicles, said anchoring points being tow hooks in this instance. Furthermore, a fixing ribbon has been carried from the tow hook to a tree, for additional fixing.

Figure 5:
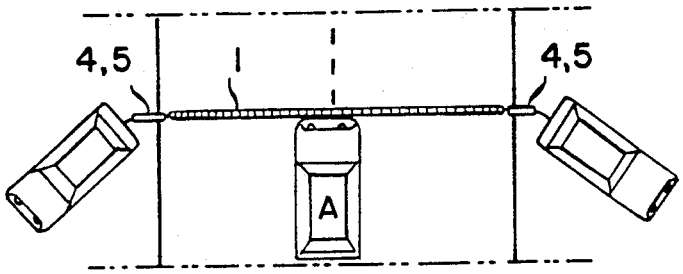
FIGS. 5, 6 and 7 present the embodiment of FIG. 4 of the invention in various stages of its use, seen from above.

In FIG. 5 the means of FIG. 4 is depicted as seen from above. The vehicle A is in the situation of the figure just about to run into the net. As the car proceeds in the net, the distension forces increase until the brake members 4 and 5 begin to operate. The first brake members 4 are opening-type fabric brakes, and the second brake members are locking-type fabric brakes. Their braking forces have been designed to be appropriate in view of the purpose, taking into account the weight of the vehicle to be stopped and the required braking distance.

Figure 6:
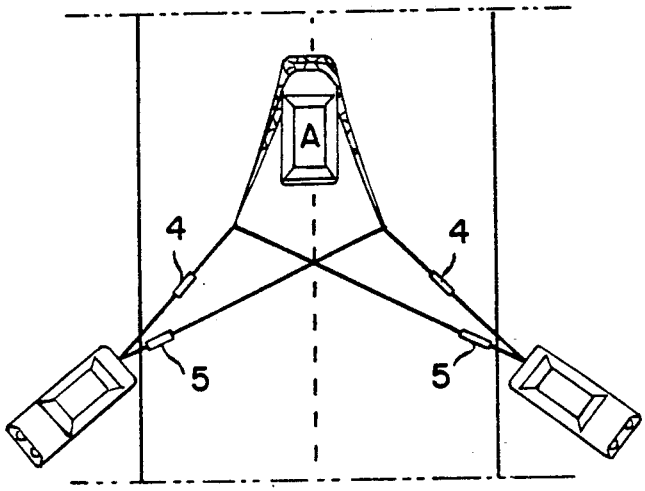

In FIG. 6 the first brake members 4 operate and furnish braking force. At this stage the second brake members 5 also begin to operate. Since the second brake members disposed on both sides of the net have been installed crosswise in relation to the net, as seen from above, the net begins to form a bag around the vehicle A.

Figure 7:
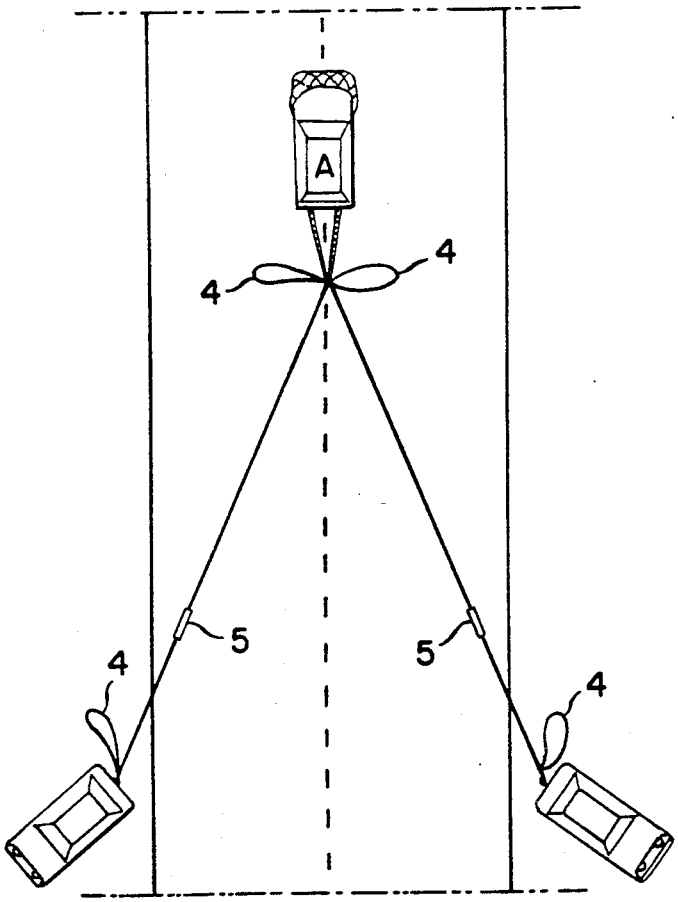

In FIG. 7 the vehicle A has proceeded even farther, whereby the first brake members 4 have completely opened and braking takes place by effect of the second brake members 5. The vehicle stops when the braking capacity of the second brake members is exhausted and they become locked. Since the second brake members had been attached to the ends of the net in crosswise fashion, as seen from above, the net ultimately shapes itself into a bag which encloses in itself at least part of the vehicle and eliminates its chances of getting out of the net.

In an operating situation of the means of the invention, a passenger car weighing 900 kg drives into a net arranged as shown in FIG. 5, with a speed of 150 km/h. The totalled braking force of the first brake members is 8000N and their operating distance, 10 m. The totalled braking force of the second brake members is 16000N and their operating distance, 50 m. The vehicle stops after it has proceeded about 60 m, and the highest deceleration is about 2 g.

Figure 8:
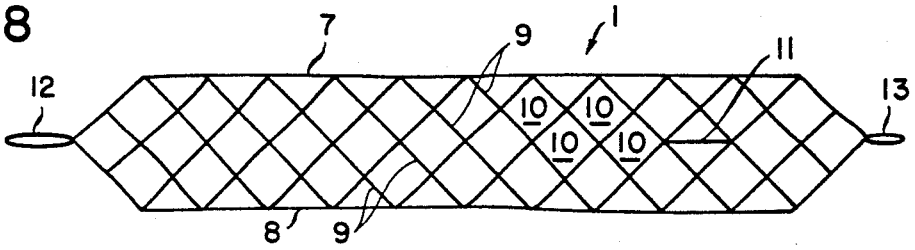
FIG. 8 presents schematically an embodiment of the net of the invention.

In FIG. 8 is shown a horizontal, elongated net 1 made of ribbon-like material, for grabbing a moving land vehicle. The net 1 comprises a head rope 7 and a foot rope 8, both longitudinal to the net, and between them warp elements 9, which form the meshes 10 of the net. The mesh size of the net is substantially consistent with the size of the wheel of the vehicle that is to be stopped or slowed down. The net has been made of flexible material which readily wraps itself around the vehicle.

All warp elements 9 of the net 1 are positioned at an oblique angle against the longitudinal direction of the net.

The meshes 10 of the net are substantially shaped like a square or rhombus standing on its point. The diagonal 11 of the net substantially parallels the longitudinal direction of the net.

The length of the diagonal 11 of the mesh 10 is 0.5 to 1.0m, suitably 0.6 to 0.9m, and advantageously 0.7 to 0.8 m. The mesh size of the net 1 is then substantially consistent with the size of the wheel of the vehicle that has to be stopped or slowed down, whereby when the net has wrapped itself around the vehicle the wheel of the vehicle readily sticks to the wheel, and the wheel will go through the mesh 10.

The height of the net 1 is 1.2 to 2.2 m, suitably 1.5 to 2.0 m, and advantageously 1.6 to 1.9 m. When the height of the net is about 1.8 m, it is best suited for stopping a passenger car.

The length of the net is 6 to 9 m, advantageously 7–8 m. The net will then extend in place across the road when stretched over the whole breadth of a two-lane roadway.

The net 1 is made of polyester fabric ribbon and/or nylon fabric ribbon. Such ribbon is particularly appropriate for material of the net because it is a light material with high tensile strength which can be packed in a small space.

The head rope 7 and foot rope 8 form on the ends of the net 1 a first hitching loop 12 and a second hitching loop 12 and a second hitching loop 13.

Figure 9:
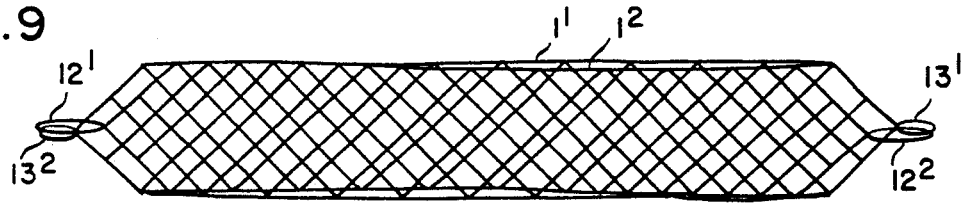
FIG. 9 presents two nets as in FIG. 8, placed one after the other.

In the embodiment of FIG. 9 the means comprises two consecutive nets $1^1,1^2$, which are in principal similar to the net which was described in connection with FIG. 8. The nets $1^1,1^2$ have in the longitudinal direction of the net been offset in relation to each other to a distance which is substantially consistent with one half of the diagonal 11 of the net's mesh.

In both nets the difference between the length in the direction of the net of the first hitching loop $12^1,12^2$ and the length in the direction of the net of the second hitching loop $13^1,13^2$ substantially equals one half of the diagonal 11 of the mesh 10. When such nets are superimposed one after the other as shown in the figure, a combination of two nets is obtained which looks denser. The corners of the vehicle will at all times be well positioned to pass through a mesh of one net or the other.

Figure 10:
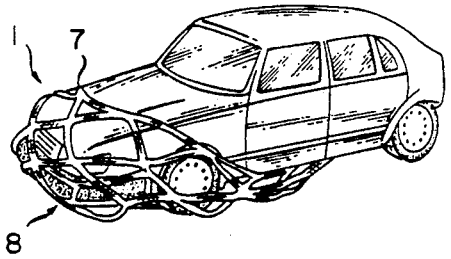
FIG. 10 presents, viewed obliquely from above, a passenger car in a situation in which another embodiment of the net of the invention has caught on the car.

It is clearly seen in FIG. 10 how the embodiment of the net formed as taught by the invention behaves when a vehicle has got into the net in a stopping arrangement in which the net 1 has on both ends been connected to fabric brake members operating stepwise as shown in FIG. 2. The height of the net 1 is about 1.5 m, length about 7.5 m; and length of the diagonal of the mesh 5 about 0.75 m. The meshes 10 of the net 1 have rhomboid shape. In a typical situation the net 1 has wrapped itself around the front part of the car. The foot rope 8 runs under the car's bumper and the head rope 7 runs over the bonnet. The front corners of the car have pushed through meshes of the net, and the car is firmly gripped by the net. The net curves along the front flanks of the car down under the car, obliquely backward and inward, as a result of the aforesaid disposition of the brake members. The net has partly gone under both front wheels of the car.

Figure 11:
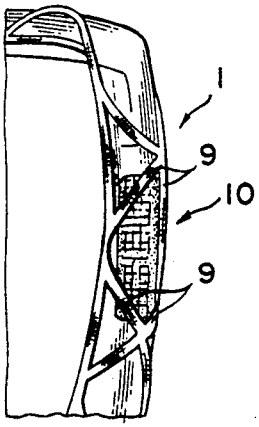
FIG. 11 shows the left front corner of the car of FIG. 10, viewed from below.

In FIG. 11 is seen the car of FIG. 10, viewed from below. Typically, a mesh 10 of the net 1 coincides with a wheel of the car. If in this situation the car tries to drive forward or rearward, the warp elements 9 will become adherent to the wheel and, together with the wheel, wrap themselves around the axle of the wheel.

When this has happened, it is impossible for the car to get free from the net any more. The net must be cut away from the car in most instances.

Figure 12:
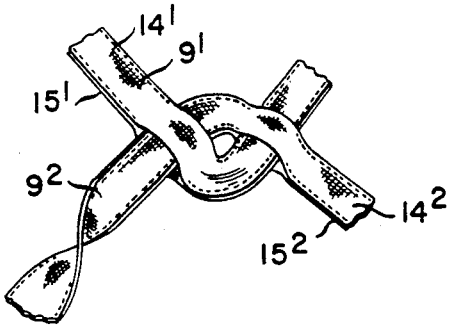
FIG. 12 shows a detail of a third embodiment of the net of the invention.

In FIG. 12 is shown an advantageous way in which the warp elements 9 of the net 1 are joined by knotting. The warp element 9 has been formed of two ribbons 14,15 stitched together, one upon the other. The crossing of the warp elements $9^1,9^2$ has been formed in that the superimposed ribbons 14,15 have been separated at the crossing and the crossing warp element passes through between the ribbons 14,15. Both warps $9^1,9^2$, of which only part is shown here, form a meandering, reciprocating configuration, and the warp elements $9^1,9^2$ have been joined at the angulation points so that first the warp element $9^2$ passes through between the ribbons $14^1$ and $13^2$ of the warp element $9^1$ at the crossing point, where these have been separated, and thereafter similarly the warp element $9^1$ passes through between the ribbons $14^2$ and $15^2$ of the warp element $9^2$. Moreover, the warp element $9^2$ has been rotated 180° about its longitudinal axis on the run between its angulation points.

The invention is not confined exclusively to concern the embodiment examples presented in the foregoing: numerous modifications are feasible while keeping within the scope of the inventive idea defined by the claims.

I claim:

1. A device for impeding the motion of a land vehicle, comprising:

a net having a first end and a second end, said ends being separated to provide an elongated net arranged for grabbing a moving vehicle;

first brake means including a first end brake member attached to said net first end and attached to a substantially fixed anchoring point on a first end side of said elongated net and a second end brake member attached to said net first end and attached to a substantially fixed anchoring point on a second end side of said elongated net for braking said net; and second brake means including a first end brake member attached to said net first end and attached to said substantially fixed anchoring point on said second end side of said elongated net and a second end brake member attached to said net second end and attached to said substantially fixed anchoring point on said first end side of said elongated net for braking said net, said first brake means includes means for slowing down motion of said vehicle, and said second brake means includes means for further slowing down and stopping motion of said vehicle, said first brake means first end brake member and second end brake member are of a length which is shorter than said second brake means first brake member and second brake member allowing said first and second brake means to function stepwise with said first brake means braking said net first and said second brake means braking said net second.

2. Device according to claim 1, wherein said brake members are discardable brake elements formed of fabric.

3. Device according to claim 1 wherein said first brake members are of an opening type and the second brake members are of the locking type.

4. Device according to claim 1 wherein said second brake means brake members are formed of fabric in which the braking force has been stepwise arranged to increase to substantially great height in conclusion of the braking.

5. Device according to claim 1 wherein said brake members are hitched to anchoring points on immobile vehicles and/or to fixing points afforded by the terrain, including ground, trees, stumps or stones.

6. Device according to claim 1 wherein a plurality of nets have been placed one after the other.

7. A net for slowing down and/or stopping motion of land vehicles at an interdiction site, comprising:

a first vertical support disposed at one side of said interdiction site;

a second vertical support disposed at another side of said interdiction site;

a head rope connected to each vertical support and extending therebetween;

a foot rope connected to each support and extending therebetween;

warp elements extending between said head rope and said foot rope to define vehicle wheel engaging means including warp elements sized for extending around a wheel of the vehicle as the vehicle runs over said foot rope, said foot rope being maintained between said vertical supports adjacent ground surface at said interdiction side, said vehicle wheel engaging means including each warp element extending at an oblique angle with respect to a longitudinal direction of said net, said warp elements having substantially a shape of a quadrangle, such as a parallelogram square or rhombus.

8. Net according to claim 7 wherein a length of the diagonal of the mesh is 0.5 to 1.0 m.

9. Net according to claim 7 wherein the height of the net is 1.2 to 2.2 m.

10. Net according to claim 7 wherein the length of the net is 6 to 9 m.

11. Net according to claim 7, wherein said net is made of polyester fabric ribbon and/or nylon fabric ribbon.

12. Net according to claim 7, wherein the head rope and foot rope form on the ends of the net a first hitching loop and a second hitching loop.

13. Net according to claim 12, wherein a difference between the length in the direction of the net of the first hitching loop and the length in the direction of the net of the second hitching loop is substantially equal to one half of the length of the diagonal of the mesh.

14. Net according to claim 7 wherein the warp elements of the net are jointed together by knotting.

15. Net according to claim 7 wherein the warp has been formed of two superimposed ribbons joined by weaving or stitching.

16. Net according to claim 15, wherein the crossing of warp elements has been formed in that the superimposed ribbons have been separated at the crossing point and the crossing warp element passes through between the ribbons.

17. Net according to claim 7 wherein each warp element forms a meanderingly reciprocating configuration, and that the warp elements are joined together at the angulation points.

18. A net for slowing down and/or stopping motion of land vehicles at an interdiction site, comprising:

a first vertical support disposed at one side of said interdiction site;

a second vertical support disposed at another side of said interdiction site;

a head rope connected to each vertical support and extending therebetween;

a foot rope connected to each support and extending therebetween;

warp elements extending between said head rope and said foot rope to define vehicle wheel engaging means including warp elements sized for extending around a wheel of the vehicle as the vehicle runs over said foot rope, said foot rope being maintained between said vertical supports adjacent ground surface at said interdiction side, said vehicle wheel engaging means including each warp element extending at an oblique angle with respect to a longitudinal direction of said net, warp element being rotated 180° about its longitudinal axis between angulation points.

* * * * *